US007377561B2

(12) United States Patent
Shin

(10) Patent No.: US 7,377,561 B2
(45) Date of Patent: May 27, 2008

(54) LOCKING AND UNLOCKING APPARATUS OF ENGINE HOOD DOOR

(75) Inventor: Han Chul Shin, Palyong-dong (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 52 days.

(21) Appl. No.: 11/286,226

(22) Filed: Nov. 25, 2005

(65) Prior Publication Data

US 2006/0260202 A1 Nov. 23, 2006

(30) Foreign Application Priority Data

May 3, 2005 (KR) ..... 10-2005-0036973

(51) Int. Cl.
*E05C 19/18* (2006.01)

(52) U.S. Cl. ..... 292/262; 292/269; 296/193.11; 296/76

(58) Field of Classification Search ..... 292/262, 292/268, 269 X, 273 X, 338, DIG. 14; 296/76, 296/100.1, 146.9; 16/360, 361, 362, 306; 49/352, 339, 386; 220/560.1, 831, 832; 180/69.2, 180/69.21–69.23

See application file for complete search history.

(56) References Cited

U.S. PATENT DOCUMENTS 1,390,751 A * 9/1921 Bell ..... 217/60 G
2,322,630 A * 6/1943 Greig ..... 180/69.21
2,434,598 A * 1/1948 Stegall ..... 292/339
4,811,440 A * 3/1989 Scott ..... 7/100
4,920,592 A * 5/1990 Scott ..... 7/100
5,664,289 A * 9/1997 Wolda et al. ..... 16/298
6,070,929 A * 6/2000 Barkley ..... 296/76
6,487,754 B1 * 12/2002 Keen ..... 16/306
6,609,583 B2 * 8/2003 Schillaci et al. ..... 180/69.21
6,892,843 B2 * 5/2005 Schillaci et al. ..... 180/69.21
6,910,545 B2 * 6/2005 Haun ..... 180/69.2

* cited by examiner

*Primary Examiner*—Patricia Engle
*Assistant Examiner*—Mark Williams
(74) *Attorney, Agent, or Firm*—Ladas & Parry LLP

(57) ABSTRACT

In a locking and unlocking apparatus of an engine hood door, a stay is formed of a first arm and a second arm, with the stay being provided so as to fix a door of an engine hood in a fixed state. The first arm and the second arm are foldably connected to each other and pivotally connected to a frame and a door respectively. The lock of the first arm is automatically locked by a locking piece of the second arm at a portion in which the first arm and the second arm are arranged on a straight line for thereby maintaining an opened state of the door. The lock is unlocked from the locking piece with the locking piece being pulled by operation of a lever which is connected with the locking piece through a wire from a remote site, so that the door is closed.

6 Claims, 9 Drawing Sheets

LOCKING AND UNLOCKING APPARATUS OF ENGINE HOOD DOOR

TECHNICAL FIELD

The present invention relates to a locking and unlocking apparatus of an engine hood door, and in particular to an improved locking and unlocking apparatus of an engine hood door in which a stay used so as to fix a door of an engine hood in an opened state is formed of two foldable arms, and a lock and a locking piece installed at the arms are automatically engaged at a position in which two arms are arranged on a straight line. A lever is installed within a user's handling range, and the lever and the locking piece are connected with a wire. With the above construction, as the wire is pulled with the lever being operated, the lock is separated from the locking piece, so that the engine hood door is closed.

BACKGROUND ART

Generally, many parts including an engine in heavy equipment such as a wheel loader, an excavator, etc. are covered by an engine hood with the engine being adapted therein to generate a certain driving force. When a part of the engine needs an exchange or maintenance, the door is opened and supported by a certain support member such as a rod so as to obtain a desired safe work in a state that the door is opened.

FIG. 1 is a perspective view illustrating a conventional locking and unlocking apparatus of an engine hood door, and FIGS. 2 and 3 are enlarged views of the conventional locking and unlocking apparatus.

As shown in FIG. 1, an engine hood 10 covers various parts such as an engine, etc. and includes a frame 20 having an opening 12 at an upper surface, and a door 40 which is hinged at one side of the frame 20 and rotates upwards and downwards about a hinge shaft 30 for thereby opening and closing the opening 12. A guide bracket 22 is fixed at both sides of the opening 12 of the frame 20, with the guide bracket having an angle shaped cross section. An upper surface of the guide bracket 22 is engaged to the frame 20 using a bolt. A guide rail 24 is formed at a side surface of the guide bracket 22. As shown in FIG. 2, a guide groove 26 is horizontally formed at the guide rail 24 in a longitudinal direction of the guide bracket 22. A fixing groove 28 is formed at an end portion of the guide groove 26 in a step shape.

As shown in FIG. 3, a guide rod 42 is slide-movable along the guide rail 24. A guide roller 44 is provided between the guide rail 24 and the guide rod 42 so that the guide rod 42 can smoothly move.

When the door is pulled with one hand holding a handle 46, the guide roller 44 at a front end of the guide groove 26 slides along the guide rail 24, and the door 40 is hinge-rotated upwards about the hinge shaft 30 and is opened. Here, since the guide roller 44 is fixedly mounted at the fixing groove 28, the guide rod 42 supports the door 40 in an upward direction.

With one hand holding the handle 46, and with the other hand holding the guide rod 42, the guide roller 44 is separated from the fixing groove 28 and is moved to the guide groove 26, the guide roller 44 slides from the rear end of the guide groove 26 to the front end of the guide groove 26, so that the door 40 is hinge-rotated downwards about the hinge shaft 30 and is closed.

However, the above conventional locking and unlocking apparatus of an engine hood door has the following problems.

For the movement of the guide roller 44 from the fixing groove 28 to the guide groove 26, the user should touch the guide rod 42 by hands. Therefore, the user's hands may be polluted by various pollutants such as sooty, dusts, etc. attached on the guide roller 42 in the interior of an engine chamber. When a strong wind is blown to the door or an external impact is applied thereto, the guide roller 42 may be severely vibrated, leading to an uncomfortable state to a user.

A certain noise may occur due to a gap between the guide groove 26 and the guide roller 44 while the guide roller 44 slides along the guide rail 24. Since the guide roller 44 slides in contact with the guide rail 24 when opening and closing the door 40, the painted surface of the guide bracket 22 may be peeled out, so that the guide bracket 22 may rust.

DISCLOSURE OF THE INVENTION

Accordingly, it is an object of the present invention to provide a locking and unlocking apparatus of an engine hood door which overcomes the problems encountered in the conventional art.

It is another object of the present invention to provide a locking and unlocking apparatus of an engine hood door in which it is possible to easily unlock a locked state without holding a guide rod with a hand.

It is further another object of the present invention to provide a locking and unlocking apparatus of an engine hood door in which a movement of a door can be minimized even when an external impact is applied to a door for thereby reducing an uncomfortable state.

It is still further another object of the present invention to provide a locking and unlocking apparatus of an engine hood door which is stably fixed at one side of a frame or a door and does not damage a frame or a door while a door is being opened or closed.

To achieve the above objects, there is provided a locking and unlocking apparatus of an engine hood door, comprising a frame which includes an opening at one side of the same and receives various parts including an engine therein; a door which is hinge-rotated about a hinge shaft of the frame for opening and closing the opening; a stay which includes a first arm of which one side is pivotally connected to the frame by a first fixing joint, and the other side is rotatable; a second arm of which one side is foldably engaged with the other side of the first arm, and the other side is pivotally connected to the door by a second fixing joint, with the stay being foldable with respect to a foldable joint which connects the other side of the first arm and one side of the second arm; a fixing means which allows the door to be fixed at an inclined angle with respect to the hinge shaft when the door is opened, and maintains a fixed state of the stay so that the first arm and the second arm may not be folded; and an unlocking apparatus which unlocks the fixed state of the stay when the door is closed.

The fixing joint includes a ring-shaped lock which is extended from the foldable joint of the first arm; a locking piece which is provided at the second arm, with the locking piece being locked by the lock; and a coil spring which is supported by one side of the second arm and allows the locking piece to be elastically biased in a direction that the lock is locked.

The lock includes a pressing surface having an inclined surface with respect to a boundary surface, and a mounting surface having a step surface, and the locking piece includes a protrusion surface mounted on the mounting surface, and when the protrusion surface presses the pressing surface, the coil spring is compressed, and when the protrusion surface is mounted on the mounting surface, the coil spring is recovered.

There are provided a plurality of locks with a plurality of mounting surfaces, and a plurality of locking grooves are formed at the locking piece.

The unlocking apparatus includes a wire connected with the locking piece; and a remote control switch which overcomes an elastic force of the coil spring and pulls the wire.

The remote control switch includes a casing which includes a shaft in an interior of the same; and a lever of which one side is connected with the wire, a center is rotatably fixed at the shaft of the casing, and the other side is elastically supported by an elastic spring in a certain direction.

The first arm is formed of a plate shaped member having a certain length, and the second arm is a two-fold plate shaped member symmetrically disposed at each side of the first arm.

There is further provided a first partition between the plate shaped members of the second arm for thereby supporting the coil spring.

The wire is received in the interior of a cable, and a second partition is installed between the plate shaped members of the second arm, and an end portion of one side of the cable is installed at the second partition, and an end portion of the other side of the cable is installed at the casing.

The first fixing joint, second fixing joint and foldable joint are formed of bolts and nuts.

With the above construction, in the locking and unlocking apparatus of an engine hood door, it is possible to easily fold the stay based on a simple operation of a lever without directly holding the stay.

MODES FOR CARRYING OUT THE INVENTION

Figure 1:
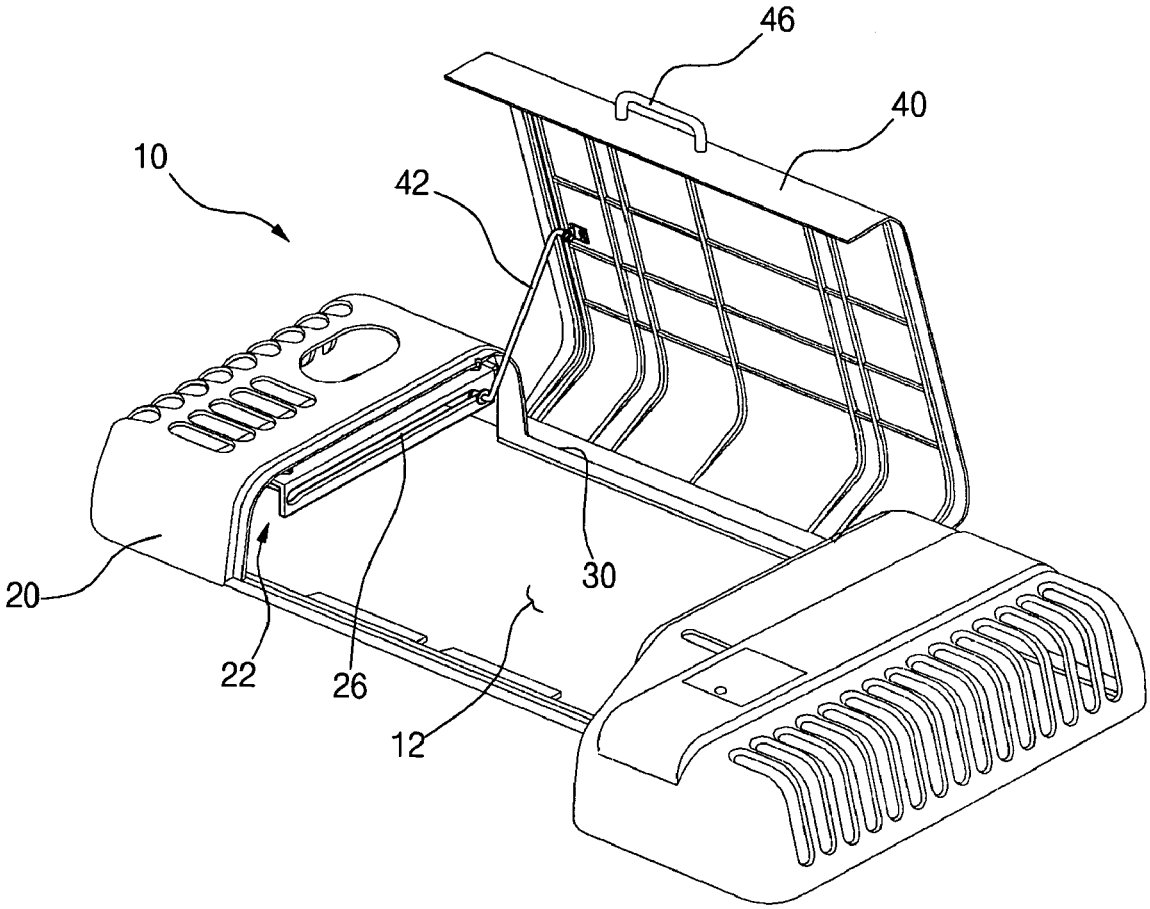
Fig.1 Prior Art
FIG. 1 is a perspective view illustrating a conventional locking and unlocking apparatus of an engine hood door.
Figure 2:
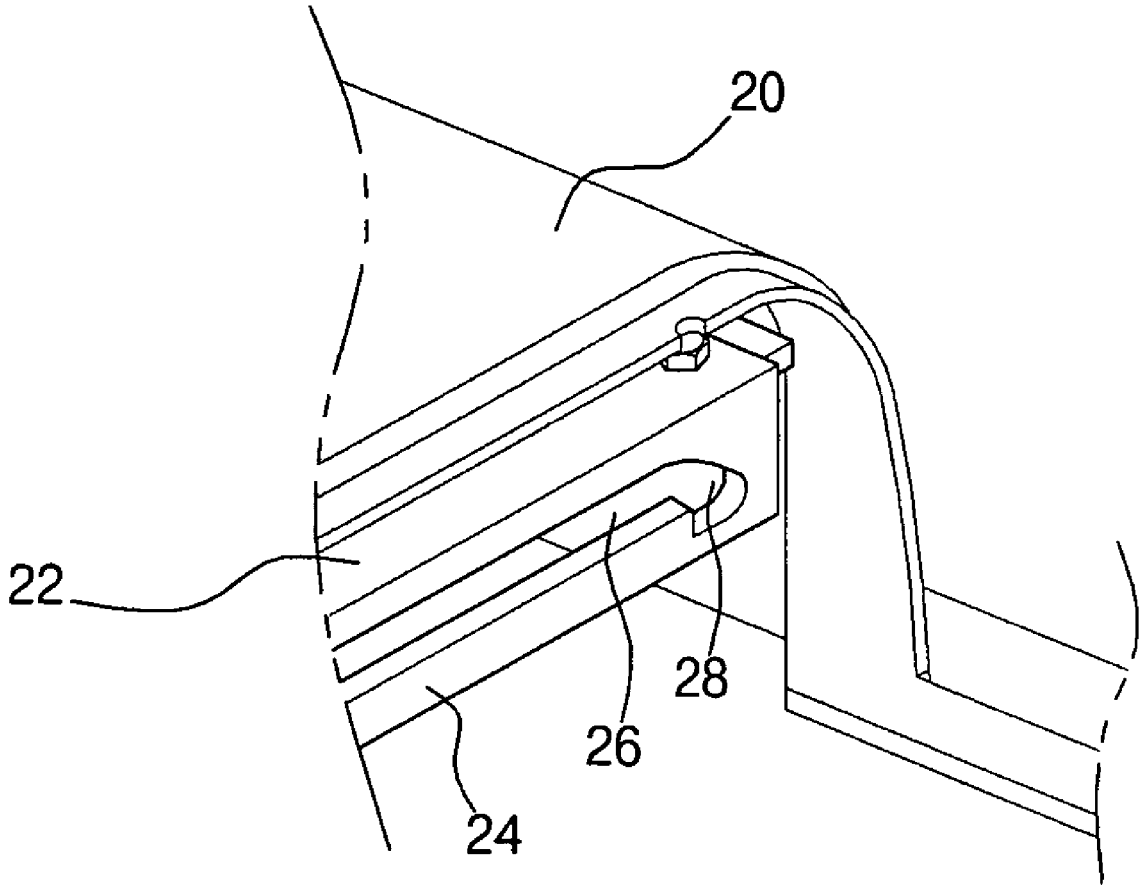
Fig.2 Prior Art
FIG. 2 is an enlarged perspective view illustrating a conventional locking and unlocking apparatus of an engine hood door.
Figure 3:
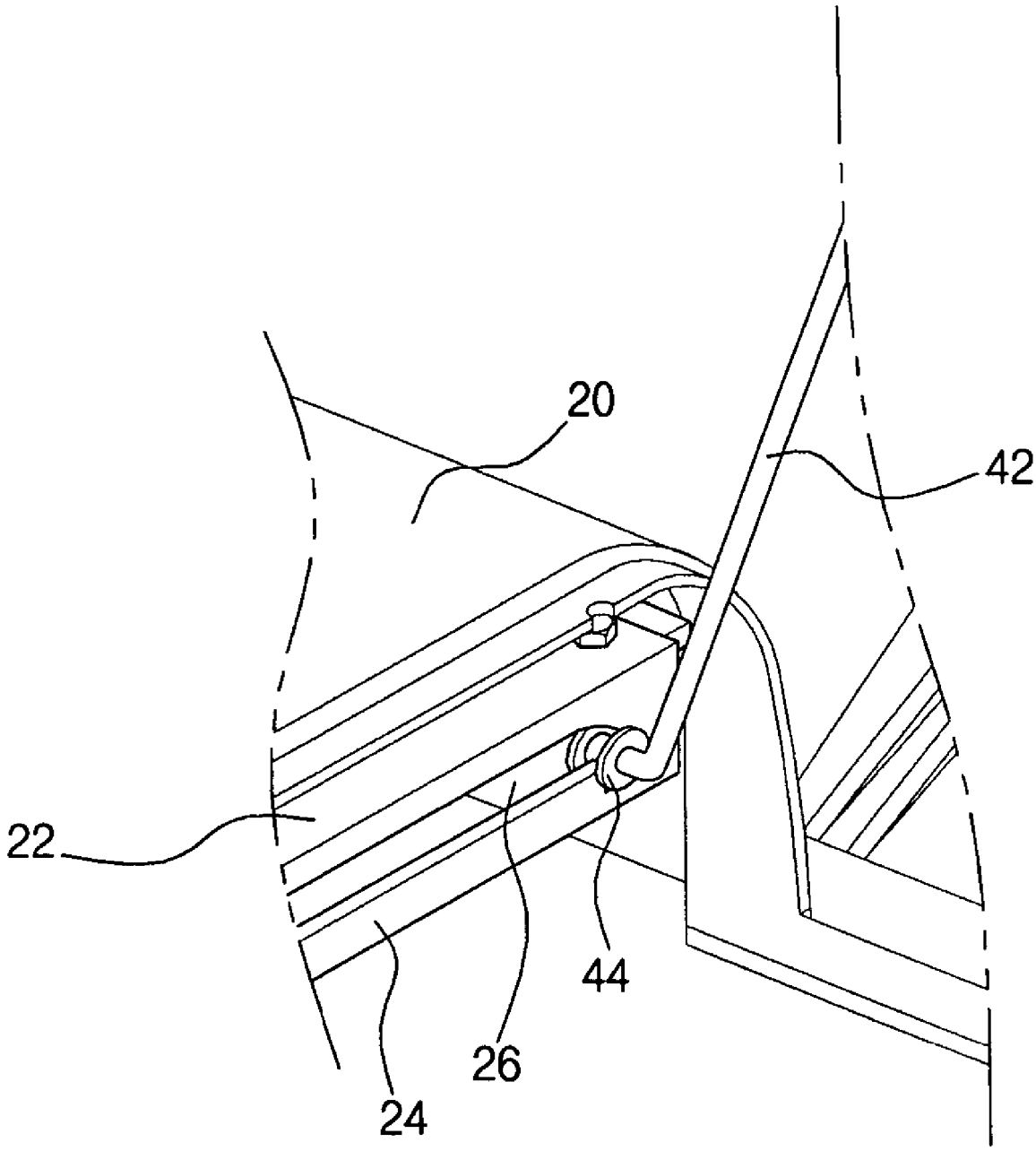
Fig.3 Prior Art
FIG. 3 is an enlarged perspective view illustrating a use state of a conventional locking and unlocking apparatus of an engine hood door.
Figure 4:
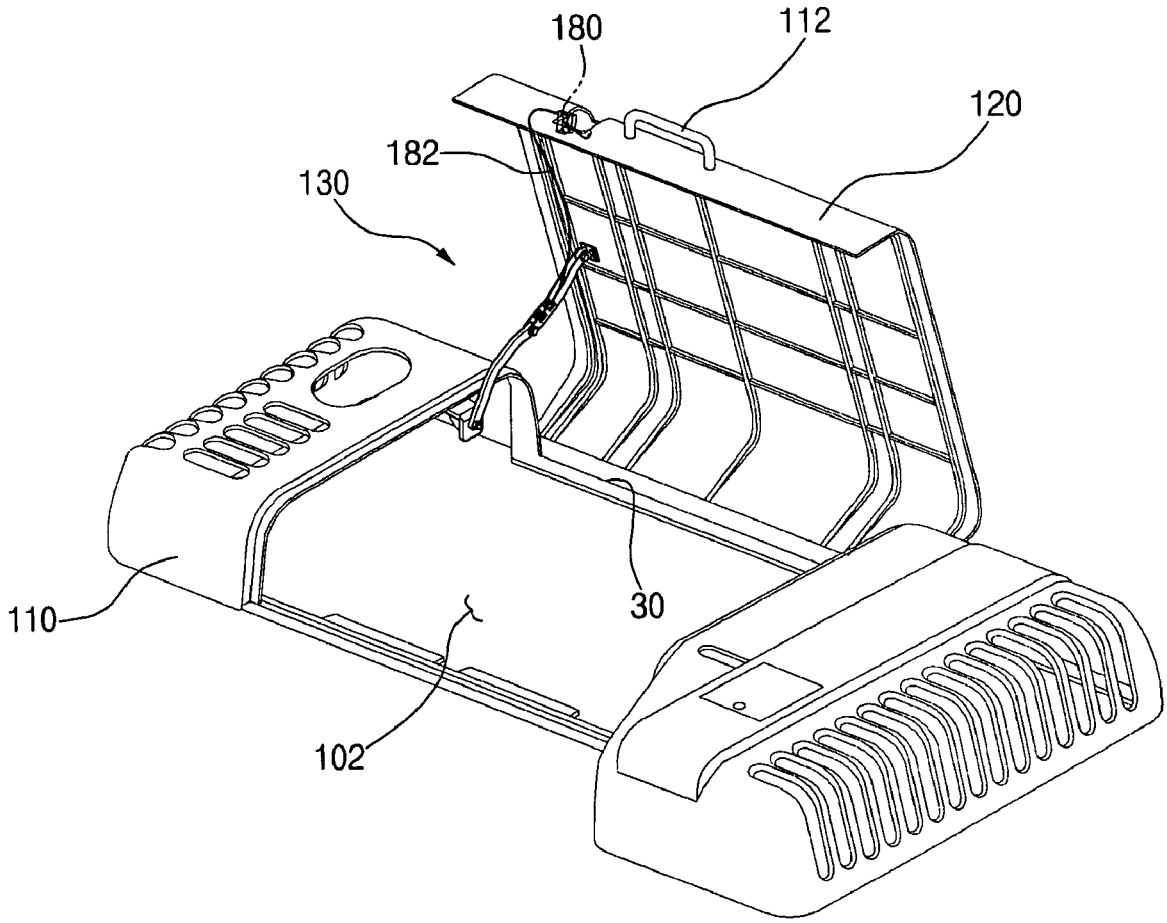
FIG. 4 is a perspective view illustrating a locking and unlocking apparatus of an engine hood door according to a preferred embodiment of the present invention.
Figure 5:
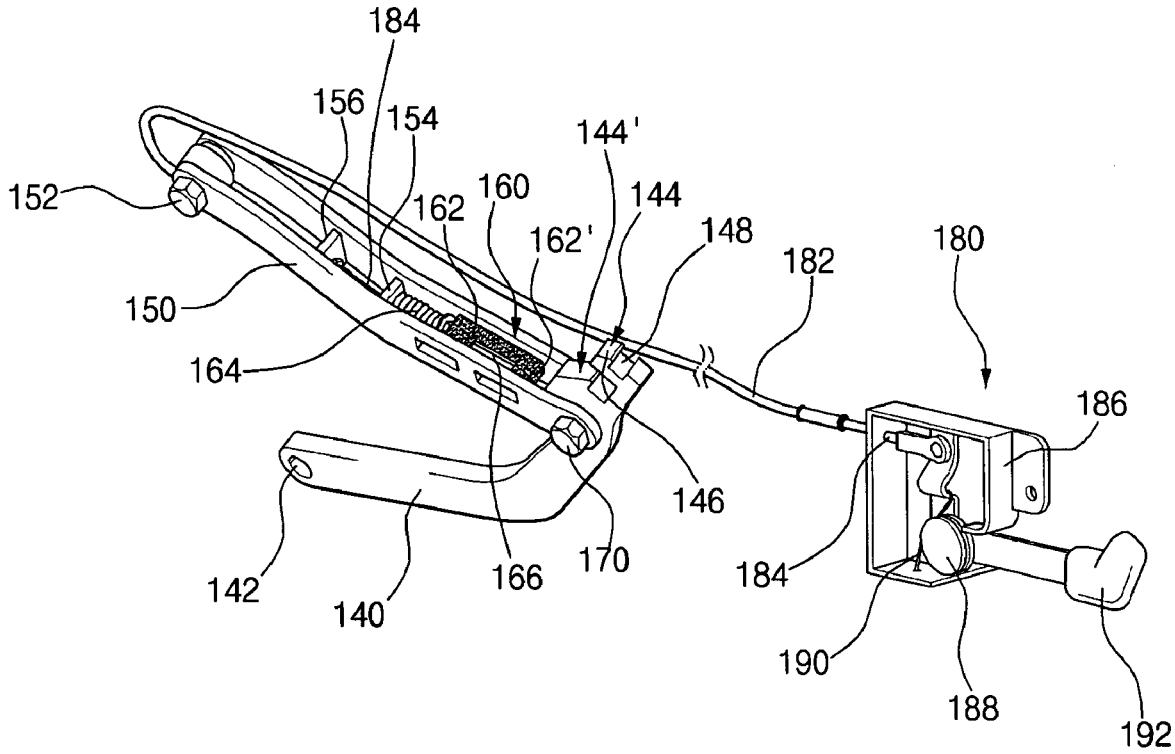
FIG. 5 is a perspective view illustrating a major part of a locking and unlocking apparatus of an engine hood door according to the present invention.
Figure 6:
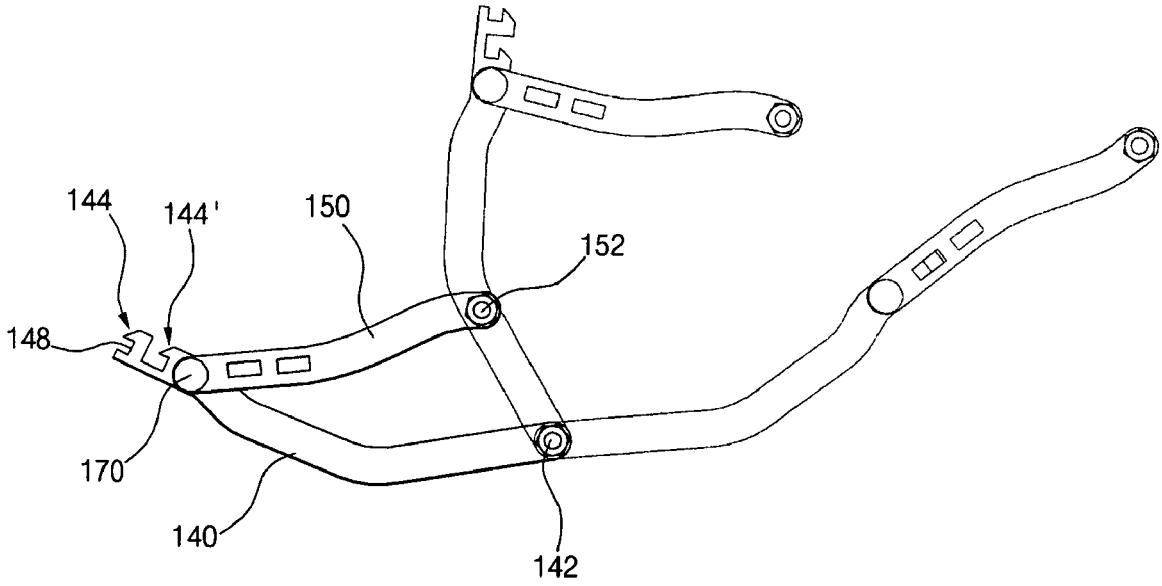
FIG. 6 is a side view illustrating an operation of a locking and unlocking apparatus of an engine hood door according to the present invention.
Figure 7A:
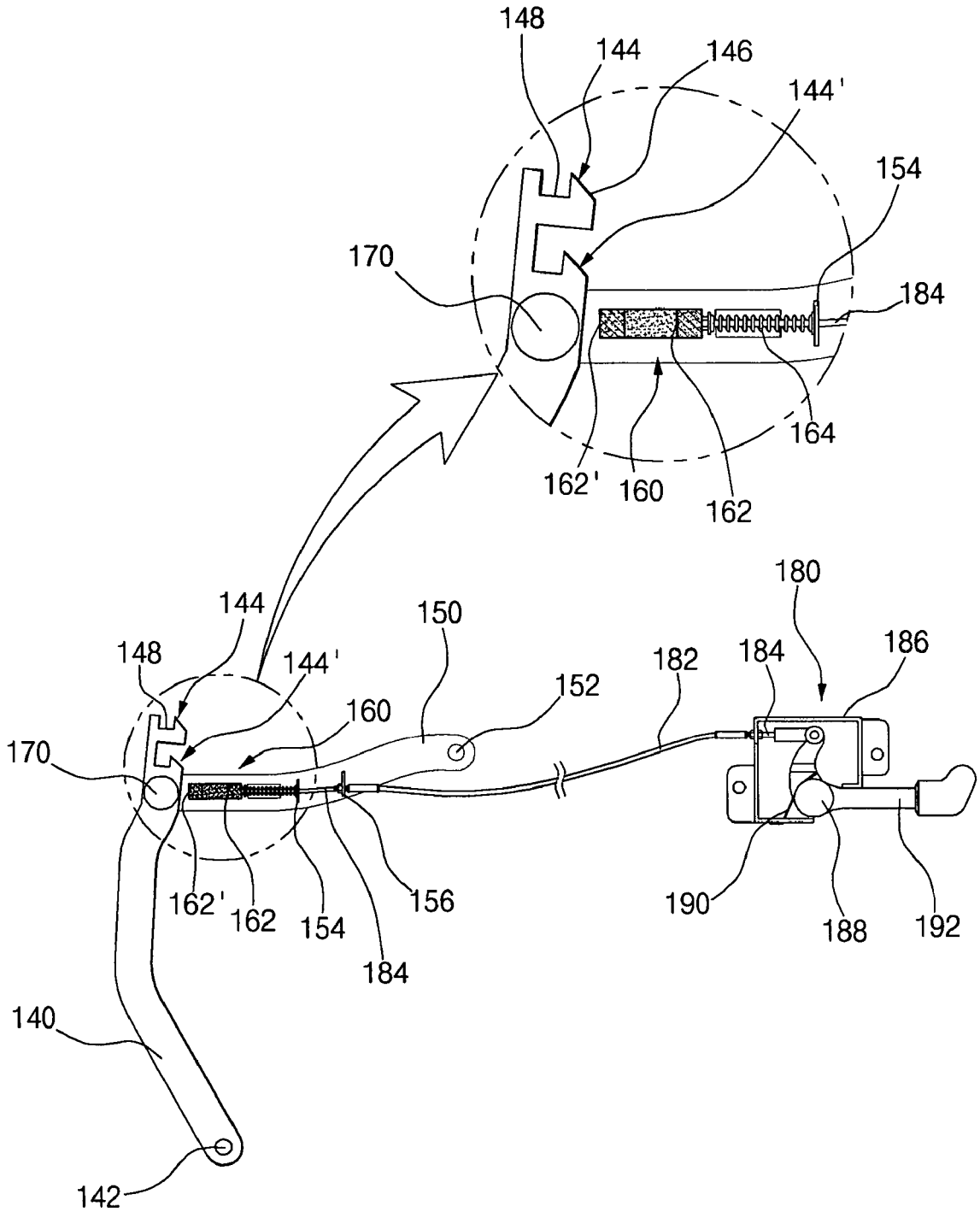
FIG. 7A is a cross sectional view illustrating an engaged state of a locking and unlocking apparatus according to the present invention in a state that an engine hood door is closed.
Figure 7B:
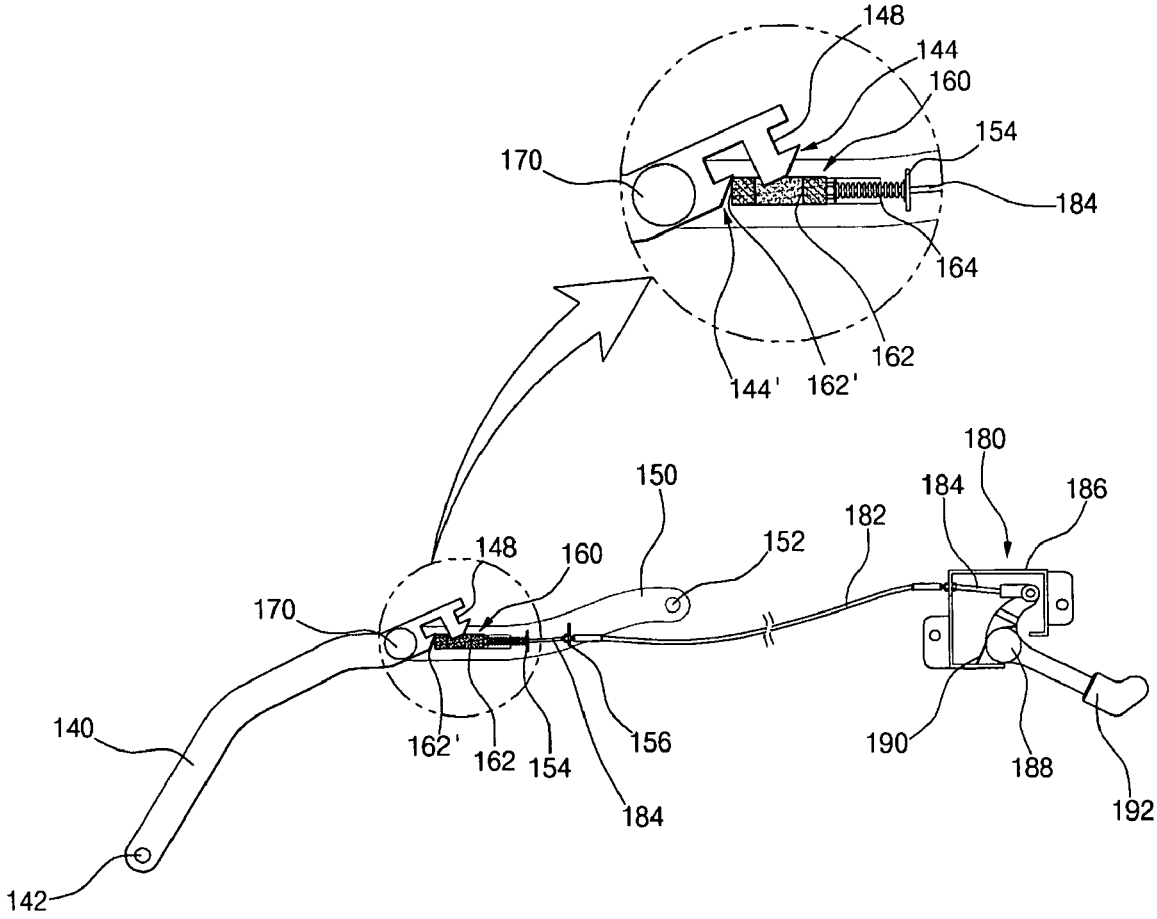
FIG. 7B is a cross sectional view illustrating an operation state of a locking and unlocking apparatus according to the present invention while an engine hood door is being opened.
Figure 7C:
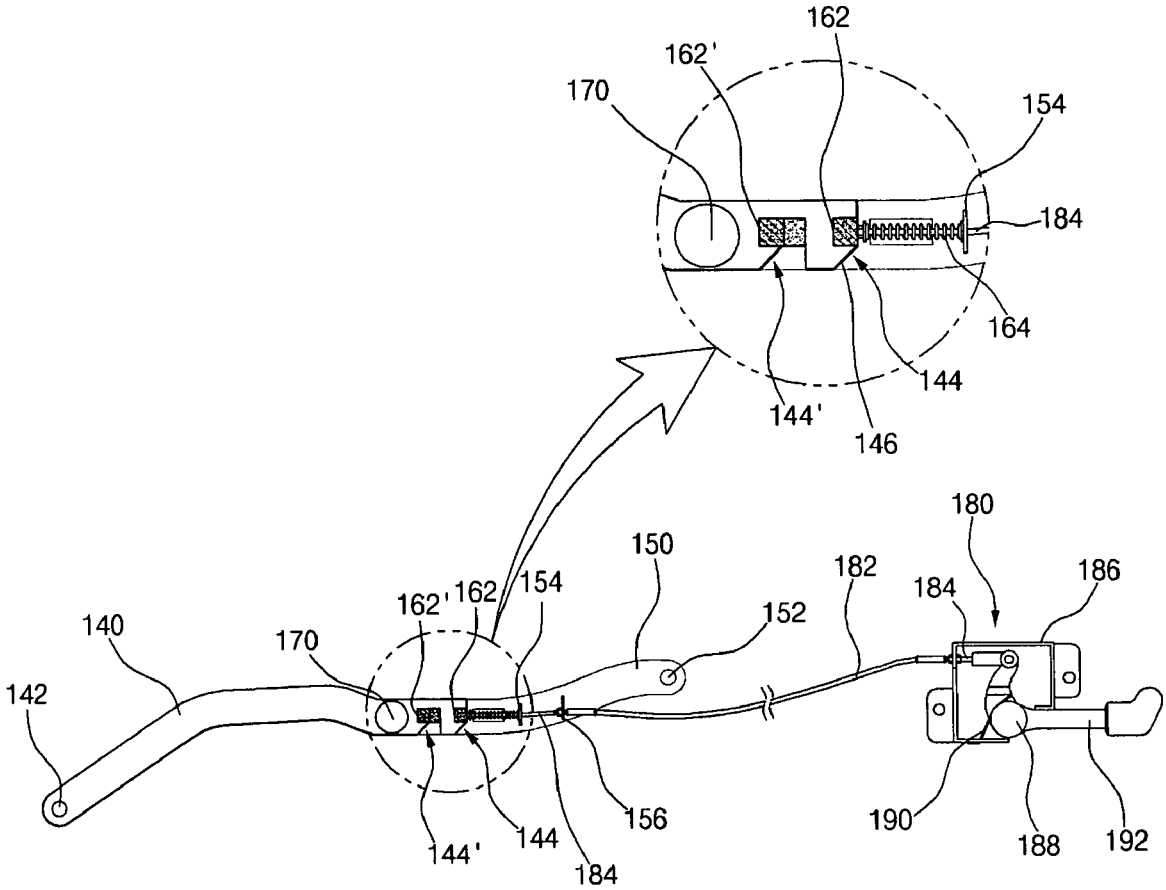
FIG. 7C is a cross sectional view illustrating an engaged state of a locking and unlocking apparatus according to the present invention in a state that an engine hood door is opened.

FIG. 4 is a perspective view illustrating a locking and unlocking apparatus of an engine hood door according to a preferred embodiment of the present invention, and FIG. 5 is a perspective view illustrating a major part of a locking and unlocking apparatus of an engine hood door according to the present invention.

As shown in FIG. 4, a locking and unlocking apparatus of an engine hood door according to the present invention includes a frame 110 which includes a rectangular opening 102 formed at an upper side of the same and receives various parts including an engine, a door 120 which is hinged at the frame 110 with a handle provided at an outer side of the door and opens and closes the opening 102, a stay 130 which supports the door 120 at an inclined angle with respect to a hinge shaft 30 of the door 120 when the door 120 is opened, and a remote control switch 180 which unlocks a locked state of the stay when the door 120 is opened.

The stay 130 includes a first arm 140 of which one side is fixed at the frame 110, and the other side is rotatable, and a second arm 150 of which one side is foldably engaged with the other side of the first arm 140, and the other side is fixed at the door 120. A foldable joint 170 formed of bolts and nuts is provided at the other side of the first arm 140 and one side of the second arm 150, so that the first arm 140 is foldable with respect to the second arm 150. Here, one side of the first arm 140 and the other side of the second arm 150 are called a first fixing joint 142 and a second fixing joint 152, respectively. The foldable joint 170 may not be limited to bolts and nuts, but may be implemented in various types such as using rivets, etc.

The first arm 140 is formed of a plate shaped member having a certain length. The second arm 150 is formed of a plate shaped member having a certain length and two fold to be disposed at each (opposite) side of the first arm 140 in a symmetrical shape with a certain gap inside the second arm 150. A first partition 154 and a second partition 156 are installed between the plate-shaped members in vertical directions.

The first arm 140 is formed between the first fixing joint 142 and the foldable joint 170 and is extended over the foldable joint 170 by a certain length for thereby forming a lock 144. The lock 144 is formed in a ring shape and includes a pressing surface 146 which has an inclination surface or a bent surface, and a mounting surface 148 having a step surface.

A locking piece 160 corresponding to the lock 144 is provided between the first partition 154 and the foldable joint 170, and the locking piece 160 includes a protrusion surface 162 mounted on the mounting surface 148.

A coil spring 164 is installed between the first partition 154 and the locking piece 160. The locking piece 160 is pressed to the direction of the foldable joint 170 by an elastic force of the coil spring 164. When the protrusion surface 162 presses the pressing surface 146, the coil spring 164 is compressed in the direction of the first partition 154. When the protrusion surface 162 is mounted on the mounting surface 148, the coil spring 164 is recovered in the direction of the foldable joint 170.

In the preferred embodiment of the present invention, a plurality of locks 144 and 144' are provided. The protrusion surfaces 162 and 162' are formed by forming a locking engaging groove 166 at the locking piece 160 for thereby enhancing a fixing function.

One end of a cable 182 is fixed at the second partition 156. A wire 184 is inserted in the interior of the cable 182, with the wire 184 being connected with the locking piece 160, so that the locking piece 160 overcomes an elastic force of the coil spring 164 and is pulled in the direction of the first partition 154.

The remote control switch 180 includes a casing 186 which has a casing shaft 188 operating as an inner shaft, with an end of the other side of the cable 182 being connected with an outer side, and a lever 192 of which one side is connected with the wire 184, the center is drivingly connected with the casing shaft 188, and the other side is biased in the counterclockwise direction by a elastic spring 190.

With the above construction, when the lever 192 is rotated in the clockwise direction, the lever 192 overcomes an elastic force of the elastic spring 190 and rotates with respect to the casing shaft 188 for thereby pulling the wire 184 in the inner direction of the casing 186. The remote control switch 180 may be installed at an inner or outer side of the engine hood so that the user can easily handle. In the preferred embodiment of the present invention, the remote control switch 180 is installed at an inner edge portion of one side of the door 120 in which the handle 112 is installed.

The operations and effects of the present invention will be described. FIGS. 6 and 7A through 7C are a side view and cross sectional views illustrating the operations of the locking and unlocking apparatus of an engine hood door according to the present invention.

When the door 120 is opened, the door 120 is rotated about the hinge shaft 30. In this state, the first arm 140 and the second arm 150 become arranged on a straight line out of the state where the first and second arms 140 and 150 are bent with respect to the foldable joint 170. At this time, the protrusion surface 162 of the locking piece 160 presses the pressing surface 146 of the lock 144 and moves along the incline d surface or bent surface of the lock 144. As the protrusion surface 162 reaches the mounting surface 148 having a step surface, the lock 144 of the first arm 140 is automatically locked by the locking piece 160 of the second arm 150, so that the stay 130 can maintain a fixed state.

When the lever 192 of the remote control switch 180 is rotated in the clockwise direction by the operation of the handle 112 so as to close the door 120, the lever 192 rotates about the casing shaft 188 and overcomes the elastic force of the elastic spring 190, and the other end of the wire 184 is pulled in the inner direction of the casing 186. The locking piece 160 connected with one end of the wire 184 overcomes the elastic force of the coil spring 164 and moves in the direction of the first partition 154. The lock 144 is unlocked from the locking groove 166 of the locking piece 160, and the first arm 140 and the second arm 150 are folded with respect to the foldable joint 170, so that the stay 130 cannot maintain the fixed state.

As described above, the stay fixing the door of the engine hood to the opened state in the frame is formed of the first arm and the second arm which are foldable and fixed at one side of the frame and one side of the door respectively. When the first arm and the second arm are arranged on a straight line, the lock of the first arm is fixedly locked by the locking piece of the second arm. In this state, the lock is unlocked from the locking piece as the locking piece is pulled by the operation of the lever connected with the locking piece through the wire.

The present invention has the following advantages.

First, it is not needed to directly hold the stay with various pollutants such as sooty, dusts, etc. The stay can be folded with a simple operation of the lever for thereby enhancing convenience in use.

Second, even when wind blows toward the door or an external impact is applied to the door, since the door is stably engaged by the lock and the locking piece, the door is not loosened or moved.

Third, when the door is opened or closed, the first and second arms are fixed at the frame and the door, respectively, by the first fixing joint and the second fixing joint. With the above construction, since only the foldable joint is repeatedly folded, the stay does not peel out the outer paint of the frame or the door, so that a reliability and safety of the product can increase.

The present application contains subject matter related to Korean paten application no. 2005-36973, filed in the Korean Patent Office on May 3, 2005, the entire contents of which being incorporated herein by reference.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A locking and unlocking apparatus of an engine hood door. comprising:

a frame which includes an opening at one side of the same and receives various parts including an engine therein;

a door which is hinge-rotated about a hinge shaft at the frame for opening and closing the opening;

a stay which includes:

a first arm of which one side is pivotally connected to the frame by a first fixing joint, and the other side is rotatable;

a second arm of which one side is foldably engaged with the other side of the first arm, and the other side is pivotally connected to the door by a second fixing joint, with the stay being foldable with respect to a foldable joint which connects the other side of the first arm and one side of the second arm;

a fixing means which allows the door to be fixed at an inclined angle with respect to the hinge shaft when the door is opened, and maintains a fixed state of the stay so that the first arm and the second arm may not be folded;

an unlocking means which unlocks the fixed state of the stay when the door is closed; and a remote control switch which overcomes an elastic force of a coil spring and pulls a wire, wherein said fixing means includes:

a ring-shaped lock which is extended from the foldable joint of the first arm;

a locking piece which is provided at the second arm, with the locking piece being locked by the lock; and a coil spring which is supported by one side of the second arm and allows the locking piece to be elastically biased in a direction that the lock is locked.

2. The apparatus of claim 1, wherein said lock includes a pressing surface having an inclined surface with respect to a boundary surface, and a mounting surface having a step surface, and said locking piece includes a protrusion surface mounted on the mounting surface, and when the protrusion surface presses the pressing surface, the coil spring is compressed, and when the protrusion surface is mounted on the mounting surface, the coil spring is recovered.

3. The apparatus of claim 1, wherein there are provided a plurality of locks with a plurality of mounting surfaces, and a plurality of locking grooves are formed at the locking piece.

4. The apparatus of claim 1, wherein said unlocking means includes:

a wire connected with the locking piece.

5. A locking and unlocking apparatus of an engine hood door, comprising:

a frame which includes an opening at one side of the same and receives various parts including an engine therein;

a door which is hinge-rotated about a hinge shaft at the frame for opening and closing the opening;

a stay which includes:

a first arm of which one side is pivotally connected to the frame by a first fixing joint, and the other side is rotatable;

a second arm of which one side is foldably engaged with the other side of the first arm, and the other side is pivotally connected to the door by a second fixing joint, with the stay being foldable with respect to a foldable joint which connects the other side of the first arm and one side of the second arm, wherein said first arm is a plate shaped member having a certain length, and said second arm is a two-fold plate shaped member symmetrically disposed at each side of the first arm, respectively;

a fixing means which allows the door to be fixed at an inclined angle with respect to the hinge shaft when the door is opened, and maintains a fixed state of the stay so that the first arm and the second arm may not be folded;

an unlocking means which unlocks the fixed state of the stay when the door is closed a remote control switch which overcomes an elastic force of the coil spring and pulls the wire; and a first partition between the plate shaped members of the second arm for thereby supporting the coil spring.

6. A locking and unlocking apparatus of an engine hood door, comprising:

a frame which includes an opening at one side of the same and receives various parts including an engine therein;

a door which is hinge-rotated about a hinge shaft at the frame for opening and closing the opening;

a stay which includes:

a first arm of which one side is pivotally connected to the frame by a first fixing joint, and the other side is rotatable;

a second arm of which one side is foldably engaged with the other side of the first arm, and the other side is pivotally connected to the door by a second fixing joint, with the stay being foldable with respect to a foldable joint which connects the other side of the first arm and one side of the second arm;

a fixing means which allows the door to be fixed at an inclined angle with respect to the hinge shaft when the door is opened, and maintains a fixed state of the stay so that the first arm and the second arm may not be folded;

an unlocking means which unlocks the fixed state of the stay when the door is closed and a remote control switch which overcomes an elastic force of the coil spring and pulls the wire, wherein said remote control switch includes:

a casing which includes a shaft in an interior of the same; and a lever of which one side is connected with the wire, a center is rotatably fixed at the shaft of the casing, and the other side is elastically supported by an elastic spring in a certain direction, said wire is received in the interior of a cable, a second partition is installed between the plate shaped members of the second arm, an end portion of one side of the cable is installed at the second partition, and an end portion of the other side of the cable is installed at the casing.

* * * * *